United States Patent [19]

Kain

[11] Patent Number: 4,865,233

[45] Date of Patent: Sep. 12, 1989

[54] POURING COVER ENGAGEABLE WITH A PLURALITY OF STANDARD CONTAINERS

[76] Inventor: Karon L. Kain, 13980 21 Mile Rd., Gowan, Mich. 49326

[21] Appl. No.: 129,840

[22] Filed: Dec. 9, 1987

[51] Int. Cl.[4] ..... B65D 25/40

[52] U.S. Cl. ..... 222/570; 222/567; 222/569; 222/482; 220/306

[58] Field of Search ..... 222/481–482, 222/541, 545, 567, 569, 570; 366/248, 247, 605; 220/306, 90.4, 85 SP

[56] References Cited

U.S. PATENT DOCUMENTS

| | | | |
|---|---|---|---|
| 2,736,536 | 2/1956 | Banowitz | 366/248 |
| 3,463,366 | 8/1969 | Spencer | 222/570 |
| 3,704,007 | 11/1972 | Kroeger | 366/248 |
| 3,844,457 | 10/1974 | Smart | 222/570 |
| 3,862,748 | 1/1975 | Grise et al. | 366/248 |
| 4,241,855 | 12/1980 | Yosh et al. | 222/570 X |
| 4,298,134 | 11/1981 | Lewis, Jr. | 220/306 X |
| 4,380,304 | 4/1983 | Anderson | 220/306 |

*Primary Examiner*—Joseph J. Rolla
*Assistant Examiner*—Boris Milef
*Attorney, Agent, or Firm*—Waters, Morse & Harrington

[57] ABSTRACT

A cover with a pouring spout is constructed to engage a plurality of standard containers, such as as paint cans, having different configurations. These cans in any given size may be of metal of plastic, and each will have a particular rim configuration. The cover is adapted to engage and seal either of there, and confine the contents of the can so that there is no leakage or rim contamination as the contents are poured out.

8 Claims, 2 Drawing Sheets

POURING COVER ENGAGEABLE WITH A PLURALITY OF STANDARD CONTAINERS

BACKGROUND OF THE INVENTION

A purchaser of a gallon of paint will inevitably take it away in one of two standard forms of container. These containers are normally cylindrical, and have a cover that closes off the open end. One of these containers is of sheet metal, and has a rim configuration that is convoluted in a particular way to receive a similarly formed cover in a press fit. The point of interengagement of the rim and the cover is radially inward from the periphery of the container. The other form of standard container is of plastic material, and has a peripheral rim flange at the open end extending radially outward and adapted to receive deformable tabs on the cover. Occasionally, a snap-on attachment of the cover to the container has been noted.

The container forms a source of supply for the paint, which must be poured out into a trough for roller application, or into a small can that can be easily held while working with a paint brush. Storage of the paint is usually in the original container, and this is where the necessity for the pouring cover arises. The act of pouring the paint out of the can into the secondary container inevitably contaminates the rim area, and often results in a streak of wet paint extending down the side of the can. As the paint hardens in the rim, it complicates the next opening of the can, and often results in contamination of the contents with specks of dried paint.

Pouring covers have been devised for particular containers, but it is inconvenient and costly to produce an inventory of a number of pouring covers for various containers of about the same size. An effective pouring cover must be capable of discharging the contents of the can without contamination of the rim area, and without permitting leakage to the exterior. It is then capable of practical use for storage purposes, making it unnecessary to re-attach a pouring cover each time it is desired to make use of some of the contents of the can.

SUMMARY OF THE INVENTION

This pouring cover has the usual spout and a universal flange surrounding a closure panel. A portion of the flange is adapted to engage the standard rim of a metal paint can. A separate wall seals off the radially inner edge of the rim. Another portion of the flange is adapted to engage the configuration of a standard plastic paint can, and seal off the inner wall against leakage. Both forms of engagement are provided with snap-on retention. A central vent hole in the closure panel is also available for the insertion of a stirring rod. This makes it possible to stir the paint without removing the cover, thereby eliminating splashing of paint. More thorough stirring also is facilitated with this type of stirring mechanism.

DESCRIPTION OF THE PREFERRED EMBODIMENTS

Figure 1:
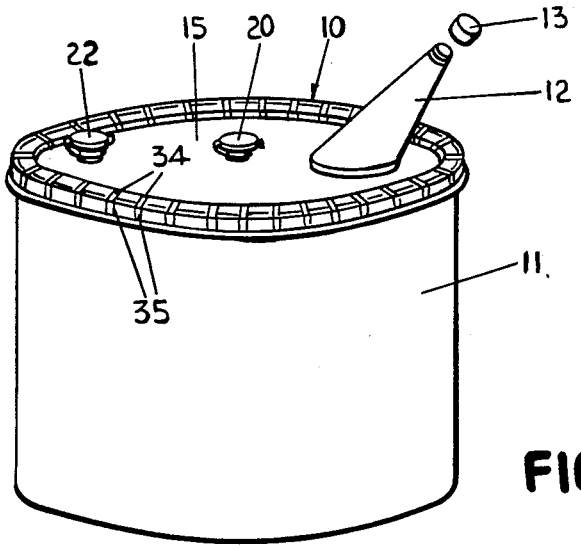
FIG. 1 is a perspective view of a container with the pouring cover attached.

Referring to the drawings, the cover generally indicated at 10 is shown in engagement with the cylindrical can 11. The pouring spout 12 has a removable cap 13 with the usual threaded engagement with the end of the spout 12. The can, or container, 11 is of metal, and is shown in FIG. 3. A container of similar size, but of plastic material, is shown at 14 in FIG. 2. The central portion of the cover is formed by the closure panel 15. A central opening in this panel is defined by the rim 16, and accommodates a stirring rod 17 in the manner illustrated in FIG. 2. Rod 17 a shaft having a lower end that is skewed at an obtuse angle from the shaft, such that the lower end and shaft fit through the central opening, while the skewed lower end is offset sufficiently to enhance the stirring action of the rod. The rod 17 is driven by the hand-held pistol drill 18, which will normally have a speed-reducing gear system to bring the rate of rotation of the rod 17 down low enough so that it will not whip air into the paint as it rotates. A fixed position collar 19 on the rod 17 is provided to limit the extent of the penetration of the rod into the can. The opening defined by the rim 16 will normally be closed by the tethered cap 20. The stirring mechanism of the present invention provides a means for thoroughly mixing the paint and insuring complete admixture of the dense pigment material that settles to the bottom of the can. An important advantage of the mixing mechanism is that mixing occurs with the cover in place, thereby eliminating splashing, even when the mixing is very rigorous.

After the contents of the can have been partially poured out, the central opening can also be used as an air vent. A second rim 21 defines an opening covered by another tethered cap 22, which may be removed to permit the inflow of air as the contents are poured out of the opposite side of the container through the spout 12. Spout 12 can either be permanently affixed to the closure panel, through integral molding or other permanent attachment means (FIG. 1), or it can be removable from the closure panel. This latter construction is beneficial when the cover is sold as a lid on a can of pain instead of as a separate item. When sold as a paint can lid, removal of the spout facilitates packing the paint cans in a conventional box without the spouts protruding upwardly. The spouts for adjacent cans can be nested together and packed between the cans inside the box, saving space.

Figure 6:
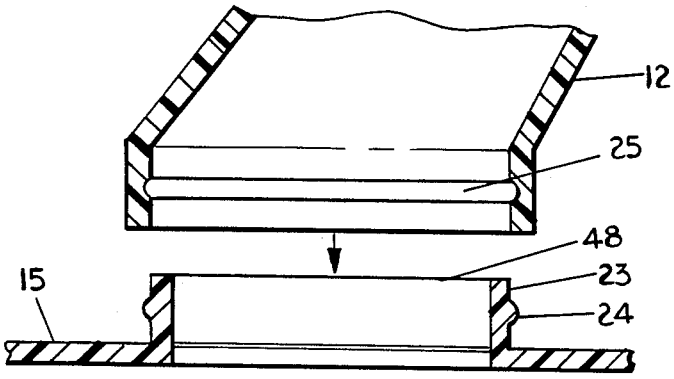
FIG. 6 is a sectional elevation on an enlarged scale showing the engagement of the removable pouring spout with the cover.

In FIGS. 3 and 6, the spout 12 is removably mounted on the rim 23 defining an opening in the cover panel 15. The spout is preferably rotatable on the rim 23 and is held in engagement by the entry of the ridge 24, with the groove 25 in a snap-in relationship. The openings defined by the rims 16, 21, and 23, will normally initially be covered by perforable membranes as shown at 48 and 26 if the cover is sold as a lid on a can of paint. The tethered covers may be provided with perforating spurs as shown at 27.

Figure 4:
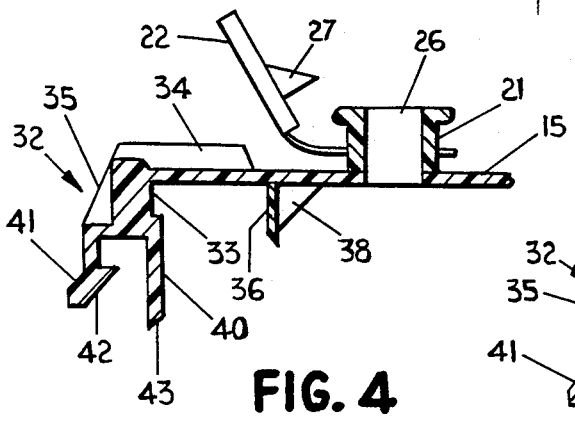
FIG. 4 is a sectional elevation on an enlarged scale of the peripheral portion of one form of the pouring cover.
Figure 5:
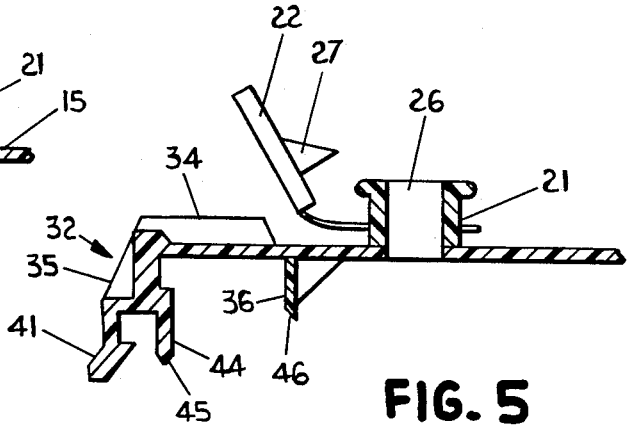
FIG. 5 is a section similar to FIG. 4, showing a modified form of the invention.

The central features of the invention are best shown in FIGS. 4 and 5, which illustrate the configuration which permits a single cover to snap into engagement with the metal container 11 and with the plastic container 14. To assist in orientation of the description, reference will be made to the axis 28 of a container, which will usually be cylindrical. The metal can 11 has a convoluted rim 29, which engages the wall 30 of the can at the peripheral bead 31 formed by crimping the material of the rim and the wall together. The flange generally indicated at 32 around the periphery of the closure panel 15, has a special configuration providing the offset 33, giving a relatively short (axially) space of increased radius adapted to engage the bead 31. The material of the integrally molded cover is selected from the available array of plastics to provide a sufficient degree of flexibility to permit a snap-in engagement of the cover with the bead 31 as the cover is pressed axially downward. This engagement is accompanied by a deflection in a clock-wise direction, as viewed in FIG. 4, of the flange 32. Some of this deflection is provided by a bending of the material of the flange itself, and some of it by the deflection of the adjacent portions of the cover panel. Where particularly thin sections of material are used, this deflection can be inhibited by the provision of stiffening webs as shown at 34 and 35. As the cover moves into full engagement with the bead 31, the annular wall 36 moves downward into contact with the radially inner extremity 37 of the rim 29 to seal it off against any outflow that would contaminate the rim. Stiffening webs 38 may also be provided to maintain the position of the wall 36 against the pressure inevitably generated by the engagement with the portion 37 of the can rim.

Figure 2:
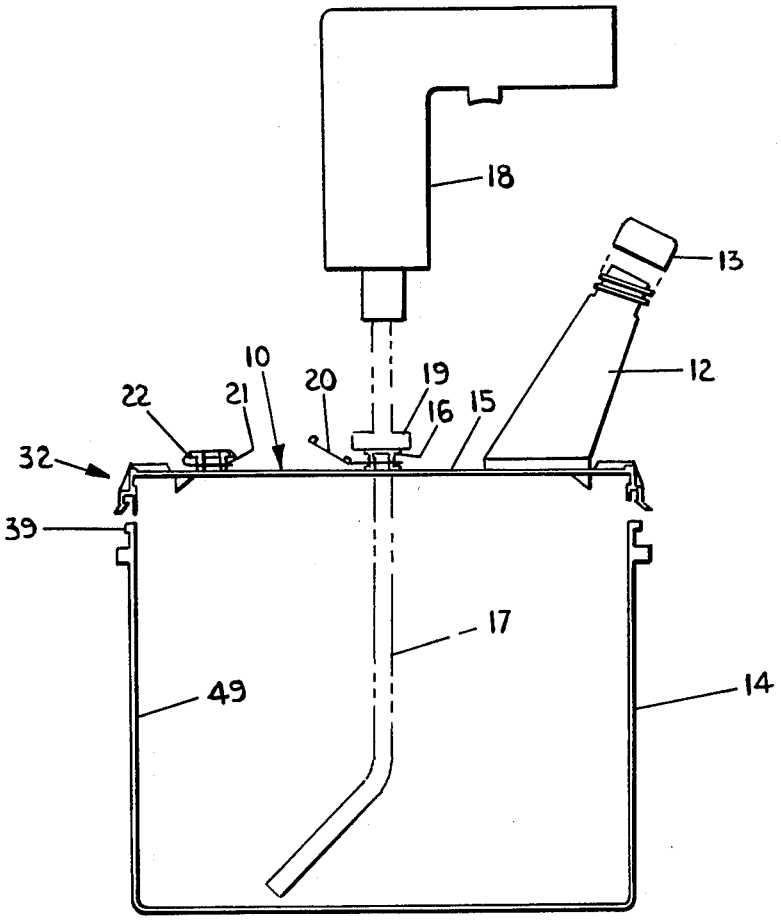
FIG. 2 is a sectional elevation of the can shown in FIG. 1, with the added provision of a stirring rod being driven by a conventional low-speed pistol drill.
Figure 3:
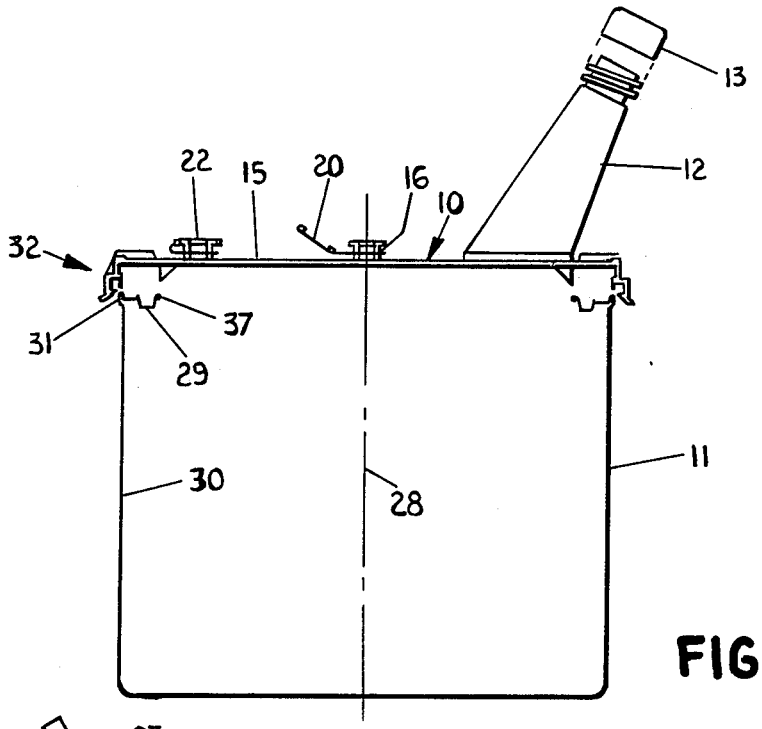
FIG. 3 is a sectional elevation showing a pouring cover with a removable spout in position to engage a standard metal paint can.

The engagement of the cover with the plastic container 14, shown in FIG. 2, involves the downward movement of the cover flange 32 over the exterior rim flange 39 of the can. This is accompanied by a slipping of the sealing skirt 40 down along side the inside surface of the container wall 49 as the latch portion 41 is cammed outwardly by the engagement of the inclined surface 42 with the top of the flange 39. In the arrangement shown in FIG. 4, the axial length of the skirt 40 exceeds that of the latch 41 so that the skirt 40, being engaged with the wall of the container before the engagement of the surface 42, will not be displaced outwardly to the point where it might possibly collide with the top of the wall of the can. In the event that the diameters of the two forms of the can are relatively close, the space available for the skirt 40 may be necessarily reduced. It must be kept in mind that the position of the skirt 40 must not interfere with the engagement of the cover with the metal can shown in FIG. 3. With this is mind, it may be desirable to bevel the lower edge of the skirt 40, as shown at 43, to facilitate the skirt slipping over the bead 31. In situations where more space is available, it may not be necessary to provide the extended length of the skirt, and a shorter skirt 44 may be provided with opposite bevels at the lower extremity, as shown at 45, to facilitate the engagement with both the metal can rim and the wall of the plastic can. This arrangement is shown in FIG. 5, which shows structure otherwise similar to that illustrated in FIG. 4. In both modifications, it is also desirable to bevel the lower extremity of the wall 36, as shown at 46, in FIG. 5. Where the exterior diameter of the metal can closely approaches the inside diameter of the plastic can, it may be necessary to manually deform the flange 32 to a considerable extent in order to properly engage the components.

The embodiments of the invention in which an exclusive property or privilege is claimed are defined as the following:

1. A pouring cover for use in combination with a plurality of standard containers, one of said containers having an axial wall and an open end provided with an interior rim flange extending inward from said wall, and also having an exterior bead at the junction of said rim and wall, another of said standard containers having an axial wall and an open end provided with an exterior rim flange extending outward from said wall thereof, said cover having a closure panel and a pouring spout, wherein the improvement comprises:

a flange extending from the periphery of said closure panel, said flange including:

(a) an internal offset adjacent said closure panel and providing an increased radius over a relatively short axial length, and adapted to receive said exterior bead, (b) a sealing skirt depending from a position below said offset, and (c) a latch spaced radially outward from said skirt, and having a hook portion extending toward said skirt and adapted to engage said exterior rim flange.

2. A cover as defined in claim 1, wherein said skirt extends axially beyond said latch.

3. A cover as defined in claim 1, wherein the exterior diameter of said one container is less than the interior diameter of said other container.

4. A cover as defined in claim 1, wherein said cover is of a material and thickness selected to render said flange manually deflectable in a radial direction.

5. A cover as defined in claim 1, additionally including a sealing wall depending from said closure panel and adapted to bear against the inside of said interior rim flange.

6. A cover as defined in claim 1, additionally including a first opening adapted to receive a stirring rod, and a cap for said first opening.

7. A cover as defined in claim 6, wherein said closure panel has a second opening, surrounded by a rim, and said pouring spout is removably engageable with said rim, said cover initially having perforable closure membranes sealing said openings.

8. A plastic pouring cover according to claim 6 and further including a rotatable stirring rod comprising an elongated shaft that is engageable with an electrically operated rotating device, the elongated shaft having a skewed outer end thereon that fits through the first opening yet is offset sufficiently to enhance the stirring action of the rod.

* * * * *